United States Patent [19]

Benno

[11] Patent Number: 4,932,528

[45] Date of Patent: Jun. 12, 1990

[54] MULTI-UNIT MULTIPACKAGES

[76] Inventor: Edward L. Benno, 17960 W. Hwy. 120, Grayslake, Ill. 60030

[21] Appl. No.: 358,588

[22] Filed: May 30, 1989

[51] Int. Cl.[5] ..... B65D 65/00

[52] U.S. Cl. ..... 206/432; 206/144; 206/150; 206/430; 206/497; 206/499

[58] Field of Search ..... 206/427, 430, 432, 144, 206/150, 151, 386, 597, 497, 499

[56] References Cited

U.S. PATENT DOCUMENTS

| | | | |
|---|---|---|---|
| Re. 27,212 | 11/1971 | Brown | 206/432 |
| T900,020 | 7/1972 | Britt et al. | 206/432 |
| 2,996,180 | 8/1961 | Bruce | 206/432 X |
| 3,454,156 | 7/1969 | Chatten | 206/430 X |
| 3,734,278 | 5/1973 | Kerrigan et al. | 206/144 |
| 3,756,397 | 9/1973 | Ganz | 206/432 |
| 3,825,113 | 7/1979 | Kramer et al. | 206/386 |
| 3,866,818 | 2/1975 | Smith | 206/427 |
| 4,304,332 | 12/1981 | Danti | 206/432 |
| 4,382,506 | 5/1983 | Chaussadas | 206/432 X |
| 4,596,330 | 6/1986 | Benno | 206/427 |
| 4,815,589 | 3/1989 | Allen et al. | 206/150 |

FOREIGN PATENT DOCUMENTS

| | | | |
|---|---|---|---|
| 2051723 | 1/1981 | United Kingdom | 206/432 |

*Primary Examiner*—Bryon Gehmon

*Attorney, Agent, or Firm*—Edward L. Benno

[57] ABSTRACT

A multi-unit multipackage for beverage type containers or receptacles made of a number of small multipackages such as the well known six-pack, which small multipackages are assembled in vertical stacks and made in to larger multipackages, which larger multipackages are assembled into trays. Features of the multi-unit multipackage inure to the benefit of beverage producers, distributors, retailers and consumers.

15 Claims, 2 Drawing Sheets

Fig. 1
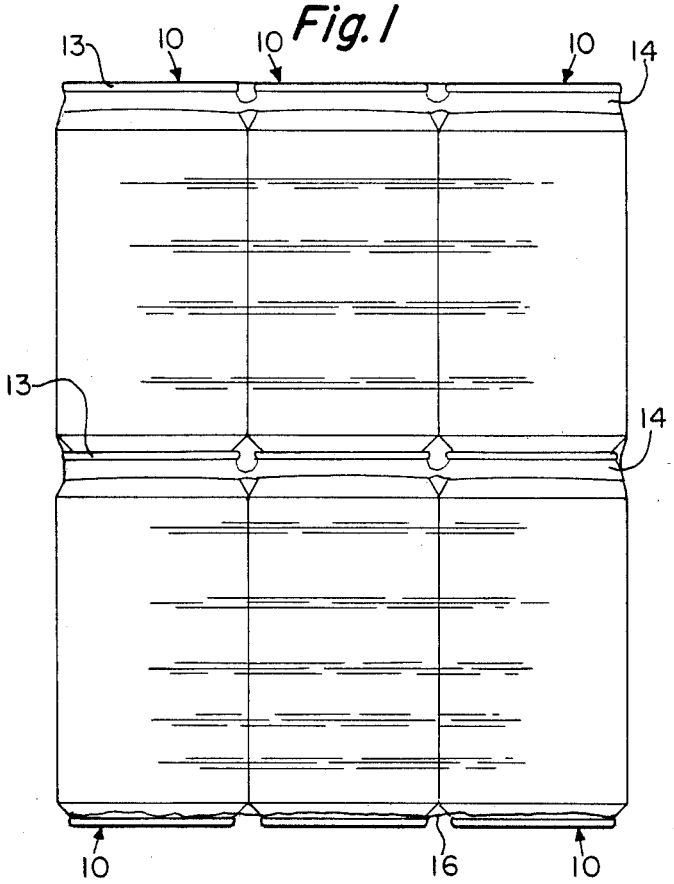
Fig. 2
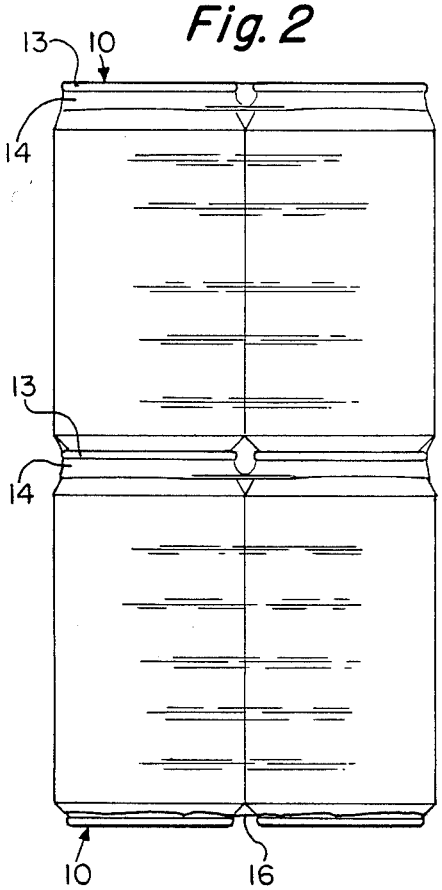
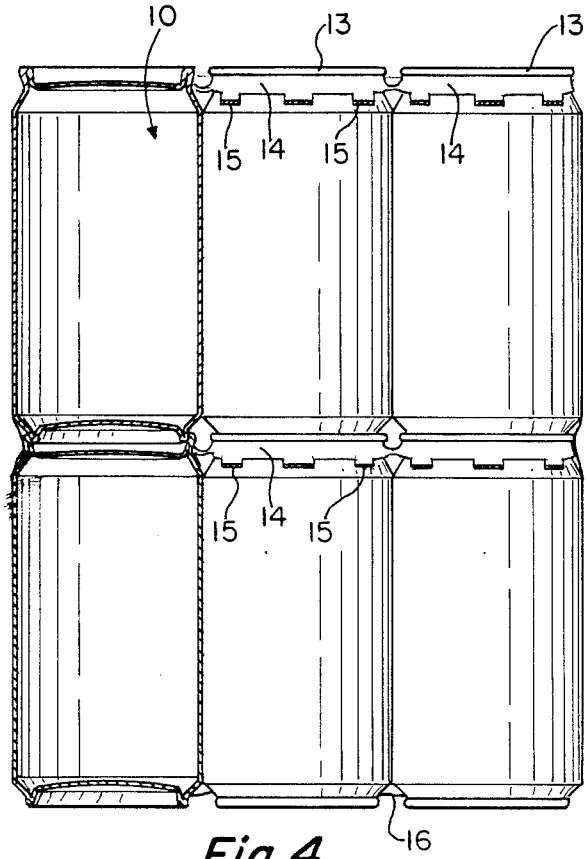
Fig. 4
Fig. 3
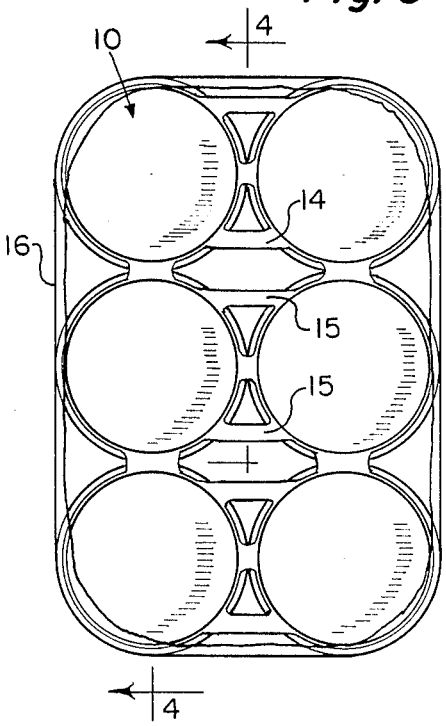

MULTI-UNIT MULTIPACKAGES

BACKGROUND OF THE INVENTION

The art of assembling and arranging a number of primary packages such as beverage type containers into secondary packaging, often called multipackaging, is an extensive art resulting from the ever changing, and often conflicting demands and needs of beverage producers, distributors, retail stores, and consumers. A secondary packaging solution that could meet the demands and needs of all concerned is a virtual impossibility, but at least partial solutions are often developed and improvements repeatedly sought.

The subject invention is one new and unique solution to the demands and needs of secondary packaging. The invention particularly relates to that area of the art of packaging where beverage type single-service containers such as cans of soft drinks and beer are multipackaged as six-packs, twelve-packs and twenty-four-packs. For various reasons, six-packs are often combined as twelve-packs, and twelve-packs as twenty-four-packs. In the beverage production and distribution segment of the art the common basic unit is twenty four containers, and that unit is called a case. When the case is a retail store item it is commonly packaged as a six-sided box of twenty four loose cans. To maintain the case unit where the intended retail store item is to be a twelve-pack or six-pack, a shallow tray is most often used by the beverage producers and distributors. In those trays, the six-sided case pattern of the cans is maintained, and that pattern is an array of upstanding cans of four columns and six rows. In the packages of cases or trays, the cans are maintained upright in handling and storage because the cans are relatively weak against vertical stacking forces when disposed on their sides. Thus such trays commonly carry two twelve-packs or four six-packs in a side-by-side relationship.

SUMMARY OF THE INVENTION

The primary object of the present invention is to make multi-unit multipackages for beverage type containers that will be more economical and/or efficient for beverage producers by reducing the number of packaging lines and and by reducing the number or size of trays and by reducing necessary inventory mix, that will be more economical and/or efficient for beverage distributors by reducing the number or size of trays that must be handled, returned or disposed of and by reducing the numbers of different multipackages that must be warehoused, that will be more economical and/or efficient for the retail store by enabling the store to stock and sell the multi-unit package or break it down to any of the smaller packages of a twelve-pack or a six-pack, and that will, at least in the twelve-pack form, provide the consumer with a simple, easily carried, secure multipackage.

The smallest multipackage of a preferred embodiment of the present invention is a six-pack comprising six cylindrical cans of some beverage with a plastics material carrier of six rings stretched about the upper end portions of each of the cans to hold the six cans in an array of two columns and three rows, and with finger holds made or provided integral with the rings somewhat centrally of the top surface of the package so that a person can grasp the finger holds and carry the package with the cans in a pendulous condition. That smallest multipackage is presently produced in great numbers by beverage producers throughout the entire country.

The next larger multipackage unit in the preferred embodiment of the subject invention is a twelve-pack made of two of the above described six-packs. The pair of six-packs are vertically stacked, one upon the other, and an open-ended tube is applied about the two six-packs to securely hold them together. The material of the tube can be any material that will securely bind the described six-packs so that a person can carry the twelve-pack by grasping the six-pack carrier of the upper six-pack or alternatively can carry the twelve-pack as a bundle with the longitudinal axis of the package disposed horizontally as perhaps cradled under a person's arm. Two preferred embodiments for the material of the tube are shrink film and stretch film. When the material is a shrink film that has been shrunk about the two six-packs, it may be necessary to have the upper and lower marginal edges of the tube shrunk a short distance over the upper end of the upper six-pack and over the lower end of the lower six-pack. This may be necessary because the shrunk film about the sides of cans may not sufficiently grip the cans to prevent the lower six-pack from dropping from the tube when the twelve-pack is carried by grasping the finger holds of the upper six-pack with the lower six-pack pendulously supported therefrom. The tube material in a stretch film form is preferred over the shrink film form. That is because an appropriate stretch film properly stretched will not have to extend over the upper and lower marginal edges of the vertical stack of six-packs even though the extensions might aid in holding the two six-packs together. For example, in one reduction to practice, the stretch film tube used was believed to be made from a polyethylene resin by an extrusion-blow molding process with a high blow ratio of the transverse direction over the machine direction in the film. That film was believed to have many more long chain molecules transversely of the tube than axially or longitudinally of the tube to render the tube substantially stretchable in the transverse direction without exceeding the elastic limits of the material. In that reduction to practice, a stretching force of about 200 pounds was necessary to stretch the tube transversely about 40% larger than its original circumference. After application to the vertical stack of two six-packs to make a twelve-pack, it was estimated that the tube pressed against the outer surface of the sides of the cans with a total force of about 150 pounds. That pressure produced by the stress of the film can be divided between the two six-packs so that it can be said to be 75 pounds on each six-pack. In stationary systems, friction manifests itself as a force equal and opposite to the shear force applied to the interface. With the lower six-pack pendulously supported through the stretched film tube from the upper six-pack, the shear force can be said to be equal to the weight of the lower six-pack and that weight was about 5 pounds and 3 ounces. When the shear force exceeds the frictional force, the lower six pack could drop from the stretched tube. The frictional force F is proportional to the normal force L, and the constant of proportionality can be defined as the friction coefficient f. This is expressed by the equation $F=fL$. Some writers estimate the coefficient of friction of a nonmetal like the film against metal like the can surface to be about 0.70. Using that amount, $F=0.70$ times the normal force produced by stress or 75 pounds, or 52.5 pounds. Thus it may be seen that the frictional force exceeded the shear force by a factor of 10, and the package had high integrity.

The next larger multipackage unit in the preferred embodiment of the subject invention is a tray for carrying two or more twelve-packs. Uniquely, the invention produces a very substantial savings in tray costs. Just in the purchase of trays, a saving of 50% or almost 50% is achieved. This saving can be particularly important where a beverage producer or distributor may elect to use injection molded plastic returnable trays as opposed to the much lower cost corrugated paperboard tray commonly used. Savings also result from lower handling costs or expenses because less trays need to be carried, stacked, handled, returned or disposed. If the beverage producers, distributors and retailers wish to maintain the twenty-four can case unit, a small tray for two twelve-packs can be used. If the present standard sized tray is to be used, the tray will carry forty eight cans rather than twenty four.

One feature of the invention is that the six-pack carriers of the upper and lower six-packs maintain the rectangular array configuration of the six-packs in the twelve-pack.

Other objects and features of the invention will be apparent upon a perusal of the hereinafter detailed description read in conjunction with the drawings.

DESCRIPTION OF THE DRAWINGS

FIG. 1 is a side elevational view of one preferred embodiment of a multipackage of the subject; invention;

FIG. 2 is an end elevational view of the multipackage of FIG. 1;

FIG. 3 is a top plan view of the multipackage of FIGS. 1 and 2;

FIG. 4 is a cross sectional view of the structure of FIG. 3 taken along the line 4—4 of FIG. 3;

DETAILED DESCRIPTION OF THE INVENTION

Figure 5:
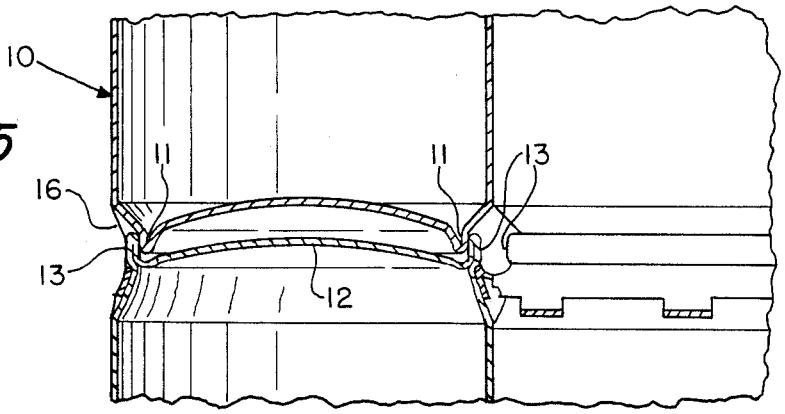
FIG. 5 is an enlarged cross sectional view of a portion of the packages of FIGS. 1–4 showing the nesting of the upper six-pack on the lower six-pack.

In a preferred embodiment of the invention, the smallest multipackage is a six-pack of beverage type containers such as the well known twelve ounce generally cylindrical aluminum beverage can used as a primary package for soft drinks and beer. All of the containers in the drawings are such cans and are shown at 10.

In a commonly used form, the can 10 is necked-in at the top, and as can be seen in FIG. 5, the lower end has an annular base ring 11 that fits or slightly telescopes within the lid 12 on top of another can 10. The chime of the can 10 about the lid 12 is shown at 13 in FIGS. 1, 2, 4 and 5. The beverages in such cans are generally under substantial pressure so that the side walls may bulge slightly outwardly. It is contemplated that beverage type containers of other forms may also be used in the practice of the invention.

The six-pack multipackage in a preferred embodiment is made by using a resilient elastic plastics material carrier 14. The carrier 14 is formed as six interconnected rings such that the interconnections align and hold the rings in a rectangular array of two columns and three rows. In the embodiment of the carrier 14 shown in FIGS. 3 and 4, finger holds 15 are formed as short straps between the two columns and on each side of the middle row of rings. Because of the cross sectional view in FIG. 4, the finger holds 15 are shown as short cut straps. The rings of the carrier 14 have an initial inner circumference substantially smaller than the outer circumference of the cans 10 immediately below the chimes 13. In assembling the six-pack multipackage, the rings of the carrier 14 are stretched and applied over the upper end portions of the cans 10 immediately below the chimes 13.

The next larger multipackage of the invention in a preferred embodiment is a twelve-pack. The twelve-pack is made by vertically stacking one of the described six-packs on top of another as can be seen in the drawings. The two six-packs of the twelve-pack are firmly secured together by a tube 16. The invention contemplates that the tube 16 can be made of any material that will firmly hold the vertical stack of two six-packs together so that a person can grasp the finger holds 15 of the upper six-pack with the package supported from those finger holds 15 in a pendulous manner to carry the twelve-pack, and that alternatively, the person can carry the twelve-pack in any oriented position as a simple secure bundle of no particularly required alignment such as up, down, or sideways. The materials of two preferred embodiments of the tube 16 are firstly, a plastics material in the form of stretch film, and secondly, a plastics material in the form of shrink film. Stretch film is preferred over shrink film for a number of reasons in practicing the invention. Firstly, the manufacturing process for making the twelve-pack with stretch film can be more simple than for shrink film because heat is not needed to shrink the stretch film. Secondly, stretch film offers the possibility of using less film by weight. Thirdly, with a tightly stretched proper stretch film, the gripping forces of the film on the outer surfaces of the cans 10 will obviate any need to extend the marginal edges of the tube 16 over the top and bottom ends of the package. Lastly, the very substantial compressive forces of a proper stretch film tube 16, will substantially increase the columnar strength of the multi-package, as might be advantageous in warehouse stacking of the multi-unit multipackages, and will aid in securing the carriers 14 on the cans 10. The latter feature produced by the tube compressive forces results when the necked-in form of the can 10 is increased toward a cone configuration by what is called in the art triple or quadruple necked-in cans. When an appropriately small carrier 14 is stretched and tightly applied about such highly necked-in cans there is a strong tendency for the lower ends of the cans 10 to splay apart using the upper shoulder of the cans 10 as a fulcrum. Such a condition occuring can be bad because the direction of splaying is the same direction for removal of a can and thus the cans 10 can be undesireably separated from the carrier 14. However, the substantial compressive forces of a stretched tube 16 will act against the lower ends of the cans 10 to stretch the carriers 14 into tight firm can holding engagement.

In making the twelve-pack multipackage of a preferred embodiment of the invention with stretch film, various attempted reductions to practice have shown the material of the tube 16 should be highly stretchable transversely or circumferentially of the tube with little stretch needed in the longitudinal or axial direction. Proper stretch films for the subject invention are at present difficult to procure, apparently primarily because multipackages such as present invention do not yet represent substantial markets for resin producers and researchers. In the packaging art, the term stretch film usually indicates a product entirely different from tube 16 of the subject invention. Common stretch film is generally produced in the extrusion-blow molding process by blowing a very large diameter bubble, many feet in diameter, and by a high speed draw in the machine direction. After slitting and winding the stretch film is commonly used for pallet winding. The blow ratio in such tubing is virtually just the opposite of that needed for practicing the subject invention. Also, because in stretching the tube 16 for application to a stack of smaller multipackages of the invention, the tube must not fracture under the load of stretching forces in excess of 100 pounds, any use of tubes made by a slit-seal process from large diameter blown tubing must have a seam at least as strong as the material. Experiments with tubes of different plastic materials appear to indicate that a suitable tube 16 is one where the blow ratio is about 2 and ½ to 1. In other words, in being blown and drawn in the substantially amorphous state the material is stretched 2 and ½ times more in the transverse direction than in the machine or drawing direction, and as this is occuring the material is cooled to its crystalline form. It is understood that in the crystalline form the material will, and should have many more long chain molecules aligned in the transverse direction, than in the machine direction. Other factors appear to be involved in the selection of a suitable stretch plastic material for the tube 16. Chemical industry people have advised this inventor that other factors are those of recovery rate, density, and creep resistance. Recovery rate is understood to mean the time rate that the material contracts after being stretched to some degree below its elastic limits. Tube 16 should have a recovery rate high enough to make a firm useable multipackage within about a minute of manufacture. This inventor's understanding of the importance of the factor of density is not fully understood. It is believed to involve the strength of the material against fracture or tearing when substantially stretched below the elastic limits of the material. Creep resistance is believed to involve the ability of the material to maintain its early elastic compressive forces for some period of time. The tube 16 in the preferred embodiments should have a creep resistance sufficient to maintain a multipackage of high integrity until the beverage is to be consumed by a consumer. A period of shelf life of about a year should be suitable.

In making the twelve-pack multipackage of a preferred embodiment of the invention with shrink film, the selection of a suitable material is relatively easy because of the present highly developed state of shrink film technology. In shrink film, tube 16 is made by securely wrapping a sheet of shrink film horizontally about the vertical stack of the two six-pack multipackages, and then cutting and heat sealing the wrap into a tube. The partially made multipackage is then placed in an oven and the shrink film is heated until it melts or shrinks securely against the vertical stack of six-packs. The multipackage is then removed from the oven and cooled to fully return the film to its stable crystalline form. In making the tube, it should be long enough so that after shrinking it extends a short distance over the top of the cans 10 of the upper six-pack and a short distance over the bottom of the cans 10 of the lower six-pack, as may be seen in the drawings. Because the cooled shrink film exerts no appreciable pressure on the cans 10, the weight of the cans 10 can exceed the frictional force, and therefore the extensions should be large enough to effectively trap or hold the two six-packs securely together as a person carries the twelve-pack by grasping the finger hold 15 of the upper six-pack with the remainder of the package pendulously supported, and alternatively carries the twelve-pack in any desired position as a bundle.

Figure 6:
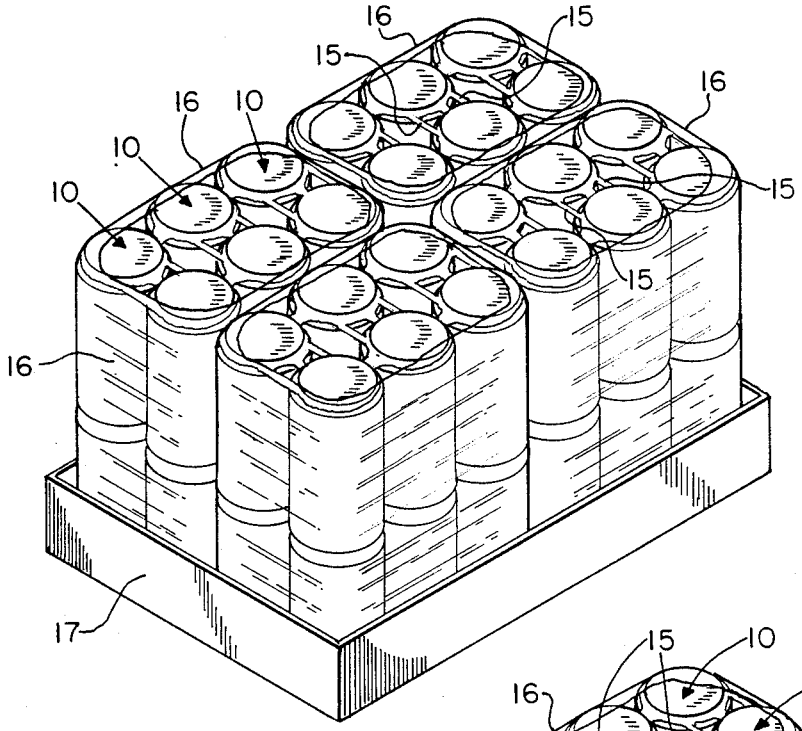
FIG. 6 is an isometric view showing a multi-unit multipackage of a preferred embodiment of the invention.
Figure 7:
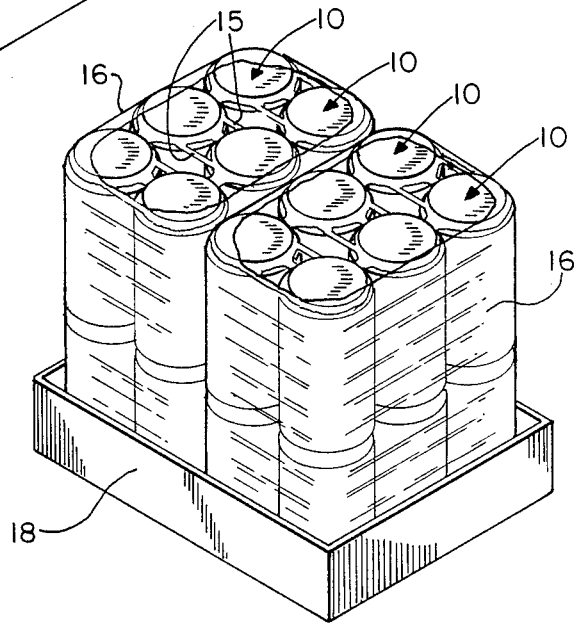
FIG. 7 is an isometric view showing another multi-unit package of a preferred embodiment of the invention.

The largest multi-unit multipackages in preferred embodiments of the invention are shown in FIGS. 6 and 7. FIG. 6 shows a tray 17 which in its lower cost embodiment is a standard commercial corrugated paperboard tray. The tray in that embodiment comprises a solid bottom wall with integral upstanding sidewalls about the periphery of the bottom wall. In the standard commercial form, twenty four twelve-ounce beverage cans in an array of four columns and six rows will be securely retained in the tray. Such trays commonly have a sidewall height of about 2 and ½ inches. As can be seen in FIG. 6, four twelve-pack multipackages of the invention are positioned to upstand in the tray 17 in close side-by-side arrangement. Thus the multi-unit multipackage of FIG. 6 enables a beverage producer, distributor, retailer, or consumer to transport and store the equivalent of eight six-packs in a tray previously used for four six-packs. It is contemplated that the tray 17 can also be made in a returnable form rather than the commonly disposable form of the corrugated paperboard tray. In a returnable form, the tray 17 can be injection molded of a suitable plastic in a skeletal form and with carrying handles at each end of the tray.

FIG. 7 shows what may be a more suitable consumer package than the package of FIG. 6, because cases of twenty four beverage cans are commonly presently sold. In FIG. 7, the tray 18 comprises a relatively low-cost corrugated paperboard tray having a bottom wall with integral upstanding sidewalls extending thereabout. The tray 18 is sized to securely carry two twelve-packs of the invention in a side-by-side upstanding arrangement with the longer sides of twelve-packs engaging each other. A consumer can easily carry and store the multi-unit multipackage of FIG. 7. Also, each of the twelve-packs can be easily carried and stored. The twelve-packs may be stored upright or on their sides for convenient storage and cooling in a refrigerator. Further, either or both of the twelve-packs can be broken down by a consumer into the six-packs and each of the six-packs can be easily carried and stored.

Having described the invention, it is to be understood that changes can be made in the described embodiments by a person skilled in the art within the spirit and scope of the claims.

I claim:

1. A multi-unit package comprising a plurality of beverage type containers, two first multipackages each of which comprises a first unitary multipackaging device and a number of said plurality of containers, said first multipackaging device comprising finger holds and means for engaging the upper portions of said number of said plurality of containers to secure said number of said plurality of containers together in an array of rows and columns to enable a person to carry each of said first multipackages by grasping said finger holds with said number of said plurality of containers pendlously supported from said first device, said two first multipackages being arranged in a vertical stack, a second multipackaging device comprising a tubular member substantially open at each end and formed to horizontally encircle said vertical stack of said two first multipackages in close encircling contact therewith and including means for holding said vertical stack of said two first multipackages together with a holding force sufficient to enable a person to carry said multi-unit package by grasping said finger holds of the first multipackaging device of the uppermost of said vertical stack of said two first multipackages with said first multipackages below said uppermost first multipackage pendulously supported therefrom and to alternatively carry said multi-unit package by grasping said multi-unit package as a bundle.

2. A multi-unit package as defined in claim 1, each of said two first multipackages comprising six containers, and said tubular member comprising a plastics material film.

3. A multi-unit package as defined in claim 2, said plastics material film comprising a resilient elastic material capable of being substantially stretched below the elastic limits thereof in the horizontal direction perpendicular to the vertical axis of said tubular member, said tubular member being in a substantially stretched condition in the horizontal direction perpendicular to the vertical axis of said vertical stack of said two first multipackages, and said substantially stretched condition of said tubular member being sufficient to produce an elastic gripping force about the outer surfaces of said vertical stack of said two first multipackages to substantially comprise said means for holding said vertical stack of said two first multipackages together.

4. A multi-unit package as defined in claim 3, wherein said containers are substantially cylindrical, and said first multipackaging device comprising a resilient elastic plastics material formed as integral stretched rings encircling the upper portions of each of said containers and integral finger holds disposed between said rows and columns.

5. A multi-unit package as defined in claim 1, each of said two first multipackages comprising six containers, and portions of the upper and lower marginal edges of said tubular member extending over the marginal edges of the respective upper and lower surfaces of said vertical stack of said two first multipackages.

6. A multi-unit package as defined in claim 5, said means for holding said vertical stack of said two first multipackages together comprising said close encircling contact of said vertical stack of said two first multipackages by said tubular member in combination with the extension of said upper and lower marginal edges of said tubular member over the respective upper and lower marginal edges of said vertical stack of said two first multipackages.

7. A multi-unit package as defined in claim 6, said tubular member comprising a plastics material film.

8. A multi-unit package as defined in claim 7, said plastics material film comprising a resilient elastic moleculary oriented material capable of being substantially stretched in the direction circumferentially thereof perpendicular to the longitudinal axis of said tubular member below the elastic limits thereof to produce a substantial stress force, and said stress force being sufficient to produce said holding force of said vertical stack of said two first multipackages by said tubular member in close encircling contact therewith and to produce said extension of said upper and lower marginal edges of said tubular member over the respective upper and lower marginal edges of said vertical stack of said two first multipackages to comprise said means for holding said vertical stack of said two first multipackages together.

9. A multi-unit package as defined in claim 8, said first multipackaging device comprising a resilient elastic plastics material formed as interconnected rings each in stretched gripping encirclement about the upper portions of one of said containers, and said first multipackaging device further comprising said finger holds being integral with said rings and exposed within the area of said extension of said tubular member over said upper marginal edge of said vertical stack of said two first multipackages.

10. A multi-unit package as defined in claim 7, said plastics material film comprising material capable of being shrunk upon being heated, said tubular member being heat shrunk to produce said close encircling contact of said vertical stack of said two first multipackages by said tubular member and to produce said extension of said upper and lower marginal edges of said tubular member over the respective upper and lower marginal edges of said vertical stack of two first multipackages to comprise said means for holding said vertical stack of said two first multipackages together.

11. A multi-unit package comprising a plurality of beverage type containers, a first group of first multipackages each of which comprises a first multipackaging device and six of said plurality of containers, said first multipackaging device comprising finger holds and means for engaging the upper portions of said six containers to secure said six containers together in an array of three rows and two columns to enable a person to carry each of said first multipackages by grasping said finger holds with said six containers pendulously supported from said first device, a second group of second multipackages each of which comprises a second multipackaging device and a vertical stack of two of said first multipackages, said second multipackaging device comprising a tubular member substantially open at each end and formed to encircle said vertical stack of two of said first multipackages in close encircling contact therewith and including means for holding said vertical stack of said first multipackages together with a holding force sufficient to enable a person to carry each of said second multipackages by grasping said finger holds of the first multipackaging device of the uppermost of said first multipackages with said first multipackages below said uppermost first multipackage pendulously supported therefrom and to alternatively carry each of said second multipackages by grasping each of said second multipackages as a bundle, and a unitizing tray for handling said second group of multipackages comprising a bottom wall having integral upstanding side wall sections extending about the periphery thereof, and said second group of second multipackages carried in said tray in side-by-side upstanding positions absent any encirclement of said tray by said second multipackaging device to enable a person to handle and carry said second group of second multi-packages by grasping and cradling said tray between the person's arms.

12. A multi-unit package as defined in claim 11, said side wall sections of said tray being substantially lower in height than the height of one of said containers, and said tubular member comprising a plastics material film.

13. A multi-unit package as defined in claim 12, said plastics film comprising a resilient elastic molecularly oriented material capable of being substantially stretched in the direction circumferentially thereof perpendicular to the longitudinal axis of said tubular member below the elastic limits thereof to produce a substantial stress force, and said stress force being sufficient to produce said holding force of said vertical stack of said group of two first multipackages by said tubular member in close encircling contact therewith and to produce said extension of said upper and lower marginal edges of said tubular member over the respective upper and lower marginal edges of said vertical stack of said group of two first multi-packages to comprise said means for holding said vertical stack of said group of two first multipackages together.

14. A multi-unit package as defined in claim 12, said plastics material film comprising material capable of being shrunk upon being heated, said tubular member being heat shrunk to produce said close encircling contact of said vertical stack of said group of two first multi-packages by said tubular member and to produce said extension of said upper and lower marginal edges of said tubular member over the respective upper and lower marginal edges of said vertical stack of two first multi-packages to comprise said means for holding said vertical stack of two first multipackages together.

15. A multi-unit package comprising a plurality of beverage-type containers, a group of two first multipackages each of which comprises a first multipackaging device and six of said plurality of containers, said first multipackaging device comprising means for holding said number of said six containers together in an array of rows and columns and finger hold means substantially at the top central area of said six containers in said array for enabling a person to carry each of said first multipackages by grasping said finger hold means with said six containers in said array pendulously supported from said first device, said group of two first multipackages being arranged in a vertical stack, a second multipackaging device comprising a tubular member substantially open at each end and formed to horizontally encircle said vertical stack of said group of two first multipackages in close encircling contact therewith and including means for holding said vertical stack of said two first multipackages together to enable a person to carry said multi-unit package by grasping said finger hold means of the first multipackaging device of the uppermost of said vertical stack of said group of two first multipackages with said first multipackage below said uppermost first multipackage pendulously supported therefrom and to alternatively carry said multi-unit package by grasping said multi-unit package as a bundle.

* * * * *